United States Patent [19]

Dormand

[11] Patent Number: 4,999,749

[45] Date of Patent: Mar. 12, 1991

[54] VANDAL RESISTANT BOLLARD LIGHT

[76] Inventor: Peter O. Dormand, 147 Rae Cres, Kotara South, Australia

[21] Appl. No.: 404,950

[22] Filed: Sep. 5, 1989

[51] Int. Cl.[5] ..... F21S 1/10

[52] U.S. Cl. ..... 362/153.1; 362/376; 362/431

[58] Field of Search ..... 362/153.1, 153, 362, 362/367, 369, 376, 431

[56] References Cited

U.S. PATENT DOCUMENTS

| | | | |
|---|---|---|---|
| 3,671,738 | 6/1972 | Beachley | 362/431 |
| 3,679,891 | 7/1972 | Quack | 362/431 |
| 3,798,438 | 3/1974 | Meniohetti | 362/431 |
| 4,231,080 | 10/1980 | Compton | 352/349 |
| 4,392,192 | 7/1983 | Steadman | 362/431 |
| 4,438,484 | 3/1984 | Winden | 362/431 |
| 4,794,502 | 12/1988 | Goggends | 362/363 |

FOREIGN PATENT DOCUMENTS

| | | | |
|---|---|---|---|
| 1801666 | 6/1970 | Fed. Rep. of Germany | 362/431 |
| 331772 | 7/1930 | United Kingdom | 362/431 |
| 1402537 | 8/1975 | United Kingdom | 362/431 |

*Primary Examiner*—Ira S. Lazarus
*Assistant Examiner*—Richard R. Cole
*Attorney, Agent, or Firm*—Christopher John Rudy

[57] ABSTRACT

An outdoor vandal resistant bollard type light is disclosed. The light is made up of, for example, of an inner lamp supporting tube, at the top of which is mounted a light source. The light source is protected from vandalism by an outer tube which has a plurality of openings in its uppermost portion in the vicinity of the light source. The outer tube also has a weather shielding diffuser tube around which the openings are located.

24 Claims, 5 Drawing Sheets

VANDAL RESISTANT BOLLARD LIGHT

BACKGROUND OF THE INVENTION

The present invention relates to bollard lights.

When lighting public areas such as parks, conventional bollard lights are mounted within and atop of the bollard, which essentially is a hollow tube. This arrangement is quite adequate when the bollard is isolated from vandalism or simple everyday use. However, if a force is applied to the bollard, the conventional separate head assembly design has been quite easily broken away by vandals rendering the fixture dangerous to the public when live wires and terminals are exposed once the separate head assembly has been broken off. This problem also leaves areas in darkness until costly repairs are carried out.

It is therefore an object of the present invention to overcome, or substantially ameliorate, the abovementioned disadvantages of conventional bollard lights.

SUMMARY OF THE INVENTION

Accordingly, one broad form of the present invention provides a bollard having mounted therein a light source, said bollard comprising:

a substantially vertical continuous outer tube having a plurality of portholes formed in an upper region thereof to allow light emission therethrough; and a cap assembly removably connected atop of said outer tube.

It is also preferable that an earthing, i.e., electrical grounding device be attached to the outer assembly. Further, the mounting of the outer assembly to the ground is preferably achieved by fixing the assembly to a concrete plynth using threaded mechanical anchors or by burying an extended version partially in concrete.

The preferable material used for fabrication of the assembly is black mild steel, hot dipped galvanized after fabrication. However, aluminium or stainless steel construction is also feasible. Any such construction material can be painted or powder coated.

A further preferred feature of the bollard light of the present invention resides in the provision of a plurality of port holes near the top of the continuous outer assembly to allow light transmission therethrough. This feature, as well as the overall simplicity of construction of the bollard allows great overall strength and eliminates the use of conventional removable head assemblies that are the cause of mechanical failure when struck by vandals. An internal diffuser made to weatherproof standard and composed, for example, of acrylic tube may be placed within the top port holed assembly to protect the lighting assembly.

It is further preferred that the cap or hat assembly be connected to the outer tube by countersunk screws or other means which allow ready removal by use of proper tools but not otherwise.

A preferred embodiment will now be described by way of example only, with reference to the accompany drawings in which:

DETAILED DESCRIPTION OF THE INVENTION

Figure 1:
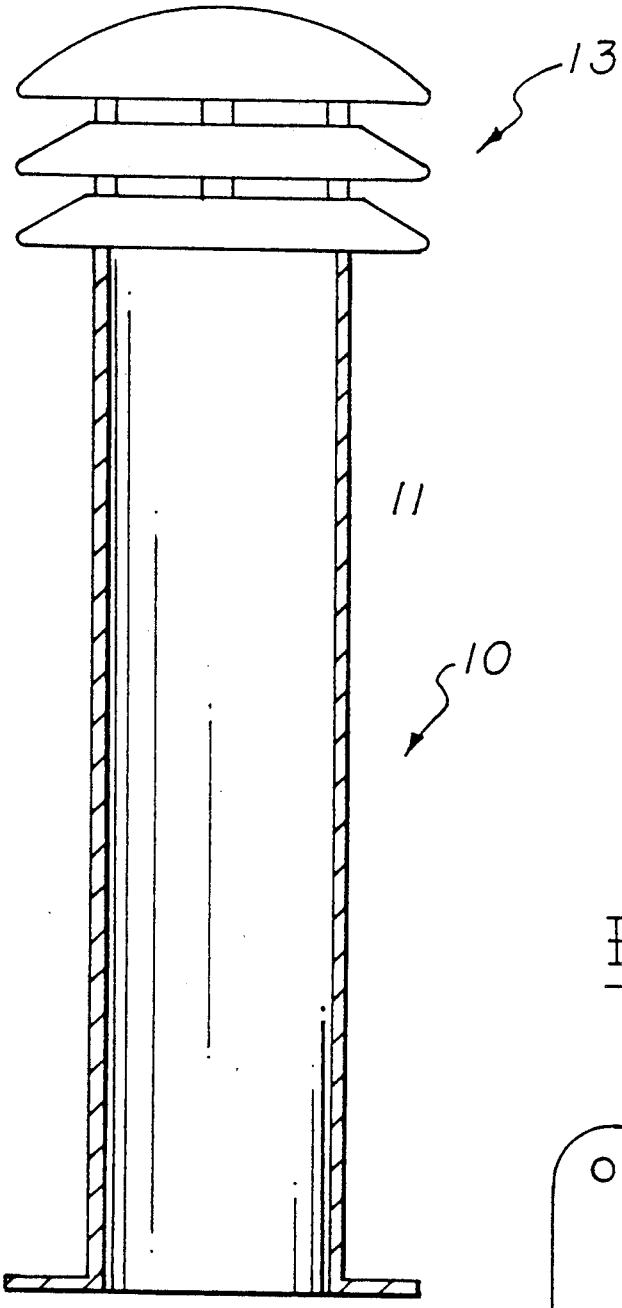
FIG. 1 is a part section view of a preferred embodiment of bollard light of the present invention.
Figure 2:
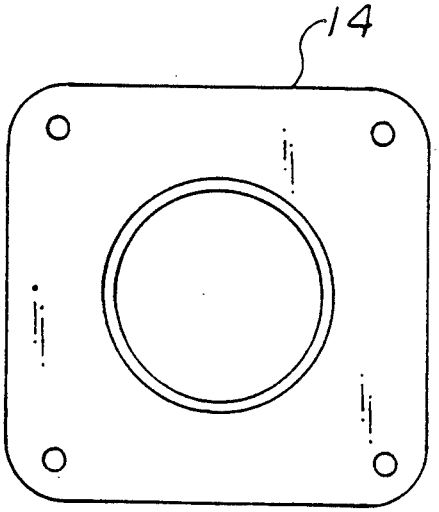
FIG. 2 is a plan view of the optional base of the outer assembly of FIG. 1.
Figure 3:
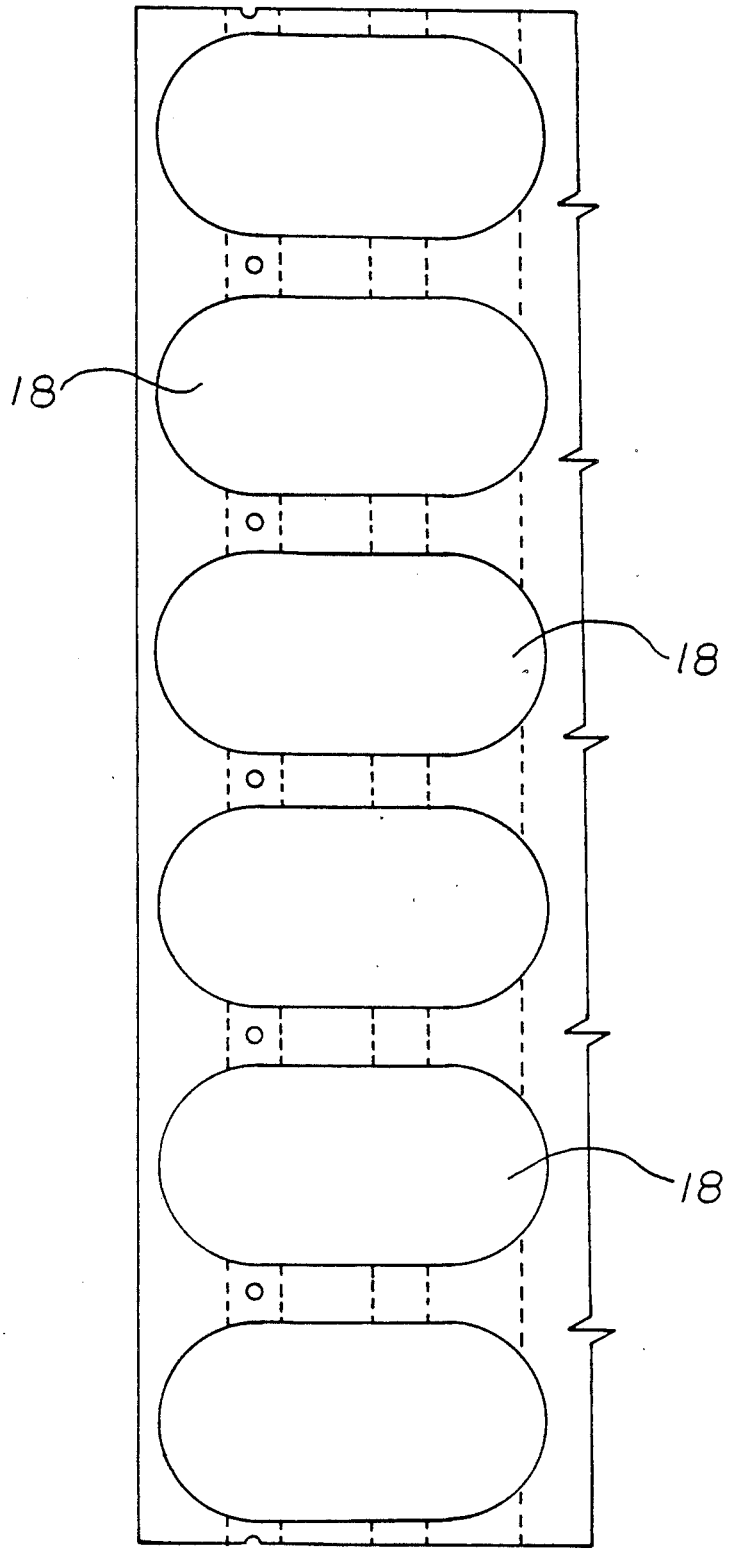
FIG. 3 is an unrolled view of the port hole layout of the head of FIG. 1.

In FIG. 1 there is depicted a part sectional view of a bollard 10, which comprises an outer assembly 11.

Figure 4:
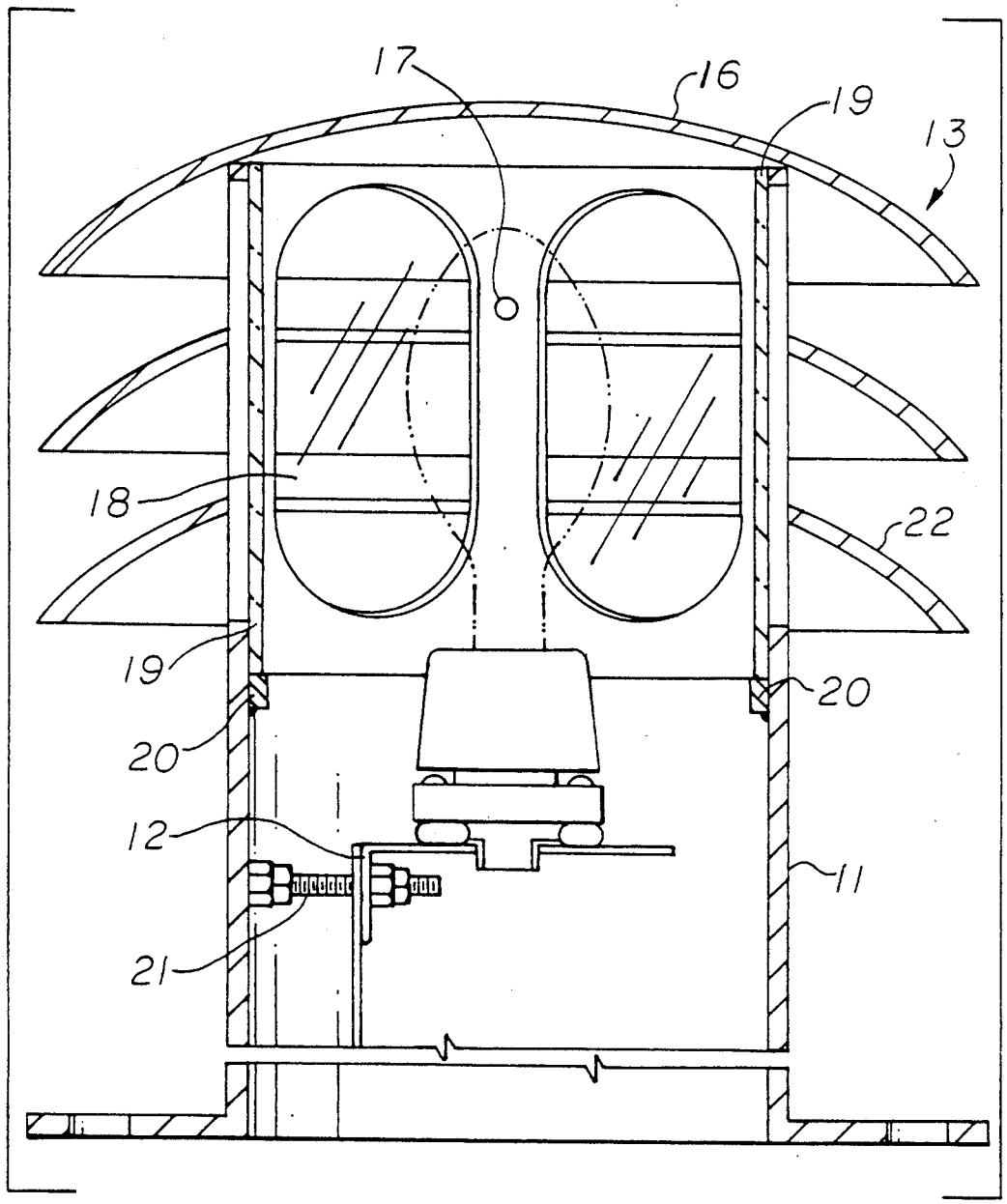
FIG. 4 is a cross sectional view of the upper portion of FIG. 1 showing an optional gear tray assembly.

The gear tray and light source assembly 12 as shown in FIG. 4 are removable through the top of outer tube 11.

The removable gear tray assembly can have mounted thereon a control system to operate the light source.

Figure 7:
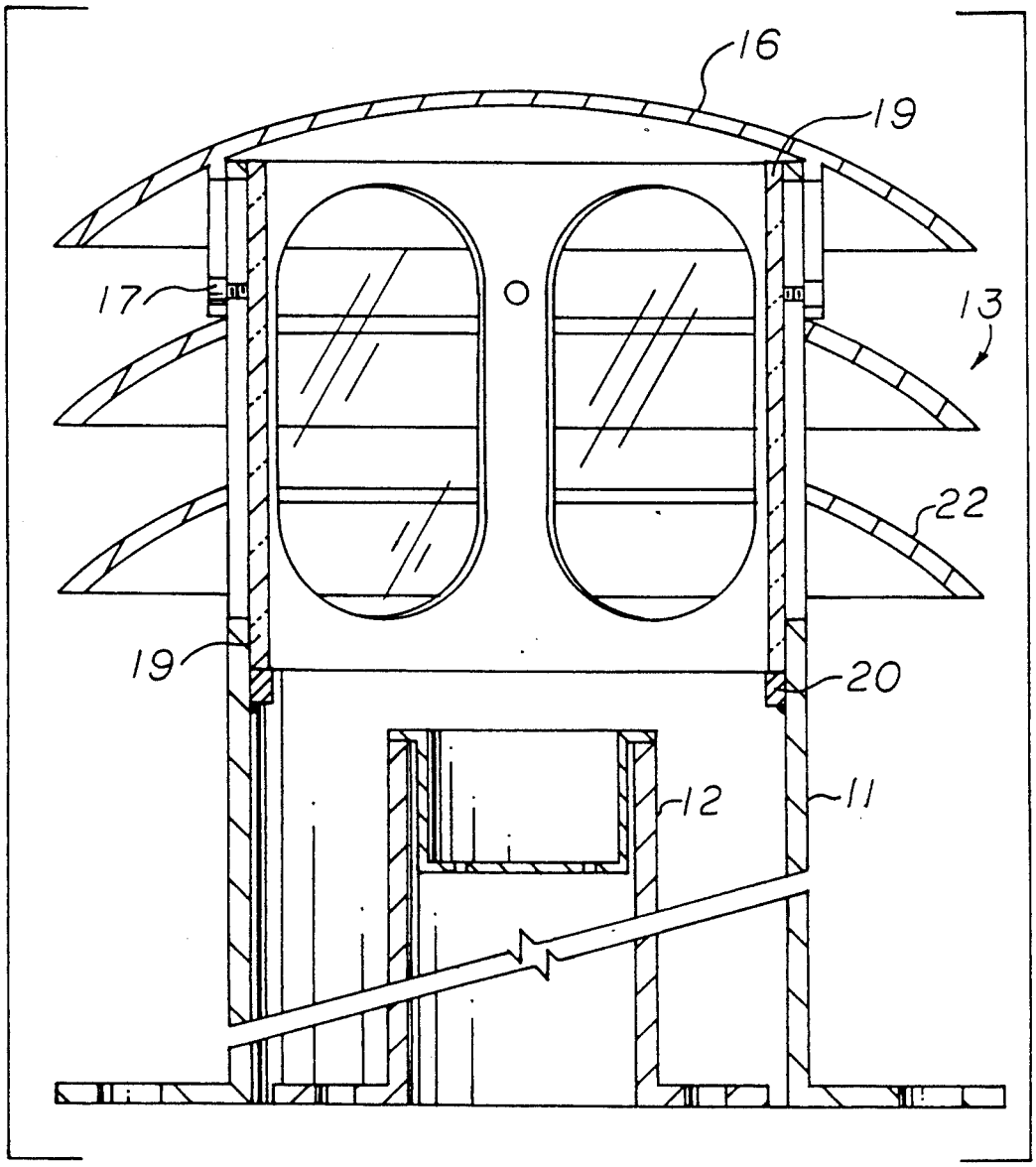
FIG. 7 is a cross sectional view of the upper portion of FIG. 5 showing the inner and outer assemblies of FIG. 5.

The head arrangement 13 is best seen in FIGS. 4 or 7, where a cap 16 is mounted to the arrangement 13 preferably by way of three hexagonal countersunk set screws 17. These screws 17 allow the cap to be removed for maintenance purposes, with use of the proper tool, but not otherwise.

The arrangement of the head section comprises a plurality of portholes 18 cut through the outer assembly to allow the cap to be removed for a lamp assembly to be transmitted through the head assembly 13. A weather-proof transparent or translucent tube 19 sits on a plurality of studs 20 to protect the apparatus.

The design allows for several different lighting sources. Examples are high pressure sodium mercury vapour, incandescent and self-contained fluorescent, any of which an be housed within the fitting.

The chosen lamp assembly may be mounted on a removable gear tray assembly 12 that is supported by the metal earthing stud 21.

Figure 5:
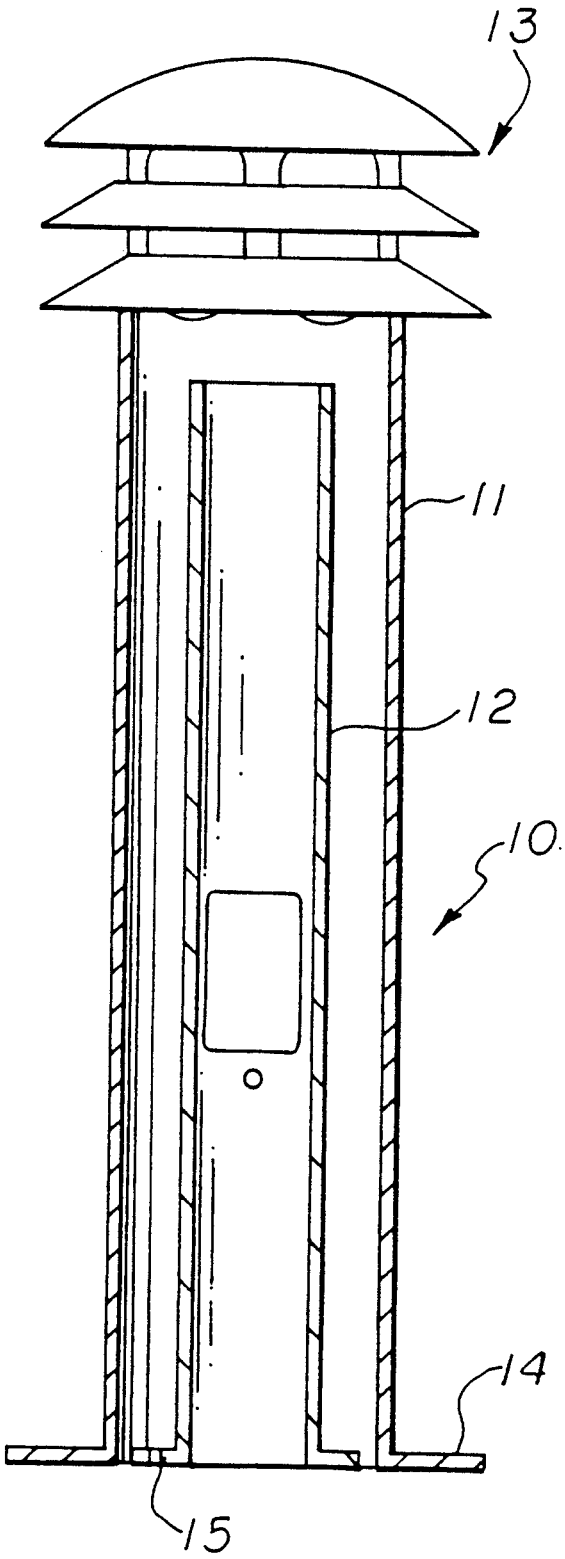
FIG. 5 is a part section view of a further embodiment of the bollard light of the present invention showing an optional inner tube.
Figure 6:
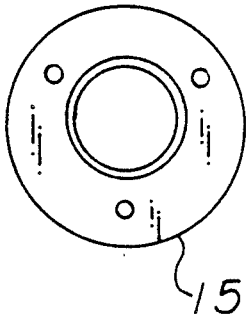
FIG. 6 is a plan of the base plate of the inner tube of FIG. 5.

In FIG. 5 there is depicted a part sectional view of a further embodiment of this invention including a bollard 10, which comprises an outer tube 11, an optional inner tube 12 having a base plate 15, similarly mounted on a concrete plynth, however, this inner tube 12 is independent of the outer tube 11.

The chosen lamp assembly may be mounted on the inner tube 12 and is thus isolated from any vibration of the outer tube 11. This protects the delicate lamp assembly and allows for longer life of both the bollard and lamp assembly. An earthing device 21 is also present on the outer tube 11.

The outer tube 11 may also have attached thereto and extending radially, outwardly therefrom in the vicinity of the portholes 18, a series of reflectors 22 to reflect the light emitted through the portholes.

Modifications obvious to those skilled in the art, can be made to the features of this invention, e.g., altering the shape or number of reflectors, or the material used for manufacture could be altered, without departing from the scope of the present invention.

What I claim is:

1. A bollard having mounted therein a light source, said bollard comprising:

a substantially vertical continuous outer tube having a plurality of portholes formed in an upper region thereof to allow light emission therethrough;

a cap assembly removably connected atop of said outer tube, and a substantially vertical continuous inner tube independently mounted to said ground surface, said concrete plynth or the like, within said outer tube via a flange attached to or integral with a bottom end thereof, said inner tube having mounting means atop thereof to mount said light source.

2. A bollard as claimed in claim 1 wherein said outer tube has attached to or integral with a bottom end thereof, a flange to allow fixing of said tube to a ground surface, concrete plynth or the like with mechanical anchor means.

3. A bollard as claimed in claim 2 wherein said outer tube flange is generally rectangular.

4. A bollard as claimed in claim 2 wherein said upper region of said outer tube has mounted therein a substantially vertical, weather shielding light diffuser tube around which said port holes are located.

5. A bollard as claimed in claim 2 including a gear tray assembly, removably mounted to an inner surface of said inner tube, said gear tray assembly having mounted thereon, a lamp assembly including said light source.

6. A bollard as claimed in claim 5 wherein said gear tray assembly has mounted thereon, a control system to operate said light source.

7. A bollard as claimed in claim 2 wherein said outer tube has attached thereto an earthing device.

8. A bollard as claimed in claim 2 wherein said inner tube flange is generally circular.

9. A bollard as claimed in claim 2 including a plurality of reflectors extending around said portholes and projecting radially outwardly from said outer tube.

10. A bollard as claimed in claim 1 wherein said upper region of said outer tube has mounted therein a substantially vertical, weather shielding light diffuser tube around which said port holes are located.

11. A bollard as claimed in claim 10 including a gear tray assembly, removable mounted to an inner surface of said inner tube, said gear tray assembly having mounted thereon, a lamp assembly including said light source.

12. A bollard as claimed in claim 11 wherein said gear tray assembly has mounted thereon, a control system to operate said light source.

13. A bollard as claimed in claim 10 wherein said outer tube has attached thereto an earthing device.

14. A bollard as claimed in claim 10 wherein said inner tube flange is generally circular.

15. A bollard as claimed in claim 10 including a plurality of reflectors extending around said portholes and projecting radially outwardly from said outer tube.

16. A bollard as claimed in claim 10 wherein said outer tube flange is generally rectangular.

17. A bollard as claimed in claim 1 including a gear tray assembly, removably mounted to an inner surface of said inner tube, said gear tray assembly having mounted thereon, a lamp assembly including said light source.

18. A bollard as claimed in claim 17 wherein said gear tray assembly has mounted thereon, a control system to operate said light source.

19. A bollard as claimed in claim 18 wherein said outer tube has attached thereto an earthing device.

20. A bollard as claimed in claim 17 wherein said outer tube has attached thereto an earthing device.

21. A bollard as claimed in claim 1 wherein said outer tube has attached thereto an earthing device.

22. A bollard as claimed in claim 1 wherein said inner tube flange is generally circular.

23. A bollard as claimed in claim 1 including a plurality of reflectors extending around said portholes and projecting radially outwardly from said outer tube.

24. A bollard as claimed in claim 1 wherein said flange is generally rectangular.

* * * * *